United States Patent [19]

Müller

[11] 4,348,268

[45] Sep. 7, 1982

[54] ELECTRODE FOR ELECTROLYSIS OF WATER

[75] Inventor: Rene Müller, Fislisbach, Switzerland

[73] Assignee: BBC Brown, Boveri & Company, Baden, Switzerland

[21] Appl. No.: 160,176

[22] Filed: Jun. 17, 1980

[30] Foreign Application Priority Data

Jun. 29, 1979 [CH] Switzerland ..... 6082/79

[51] Int. Cl.[3] ..... C25B 11/12; C25B 1/04; H01M 4/48

[52] U.S. Cl. ..... 204/290 R; 204/290 F; 204/294; 429/40

[58] Field of Search ..... 204/290 R, 290 F, 294; 429/40

[56] References Cited

U.S. PATENT DOCUMENTS 3,632,498 1/1972 Beer ..... 204/290 F
3,647,641 3/1972 Grubb et al. ..... 204/1 T
3,810,770 5/1974 Bianchi et al. ..... 204/290 F X
3,824,175 7/1974 Schultz et al. ..... 204/290 G
4,140,616 2/1979 Wheatley et al. ..... 204/268

OTHER PUBLICATIONS

Fuel Cell Technology & Berger, pp. 401–406, Pub. by Prentice Hall, (1968).

Fuel Cells and Fuel Batteries by Liebhalfsky, pp. 289–294 Pub. by John Wiley & Sons, (1968).

*Primary Examiner*—F. Edmundson

*Attorney, Agent, or Firm*—Oblon, Fisher, Spivak, McClelland & Maier

[57] ABSTRACT

A bipolar electrode for electrolysis of water. A porous graphite plate is coated on one face with a layer of $TiO_2$ doped with a mixture of $RuO_2$ and $IrO_2$. The uncoated surface of the porous graphite plate may be grooved.

2 Claims, 1 Drawing Figure

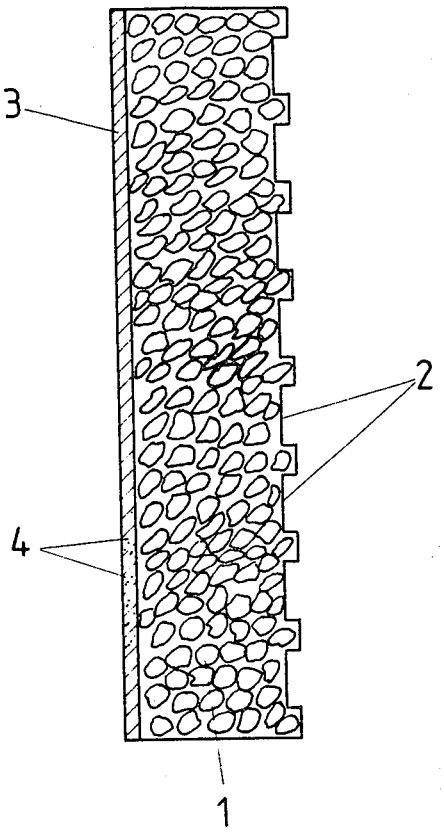
3
2
4
1

ELECTRODE FOR ELECTROLYSIS OF WATER

BACKGROUND OF THE INVENTION

1. Field of the Invention

This invention relates to an electrode for electrolysis of water and more particularly to a porous electrode having a catalytic coating for improving the efficiency of the electrolysis.

2. Description of the Prior Art

Many electrodes and processes for their preparation have been developed in the area of fuel cell technology. Such electrodes are described in, for example, Berger, C., *Handbook of Fuel Cell Technology,* Prentice Hall, 1968, pp. 401–406, and Cairns, E. J. Liebhalfsky, Fuel Cells and Fuel Batteries, John Wiley & Sons, 1968, pp. 289–294. Since the zones for the various reactions occurring in fuel cells must be carefully separated and accurately defined these fuel cell electrodes have multiple layers and require special treatment in their preparation.

Fuel cell electrodes of the above types are unnecessarily complicated for electrolysis of water, and, moreover, the preparation of such electrodes is, in general, too expensive. These deficiencies are especially disadvantageous when the methods are to be used in making large industrial apparatus for the economical preparation of hydrogen.

Electrodes for cells used in electrolysis of water have already been described, for example, in U.S. Pat. 4,039,409. These are generally doped with a catalyst to accelerate the electrochemical reaction.

However, the known electrodes leave something to be desired in their electrical and mechanical properties, and the same is true regarding the catalysts which have been used.

Hence a need has continued to exist for an electrode suitable for electrolysis of water which is efficient and can be manufactured by a simple and economical process.

SUMMARY OF THE INVENTION

Therefore, it is an object of this invention to provide an electrode for electrolysis of water which has good mechanical and chemical stability.

A further object is to provide an electrode for electrolysis of water which has a high electrical conductivity and good permeability to water and gas.

A further object is to provide an electrode for electrolysis of water which has a long life.

A further object of the invention is to provide an electrode for electrolysis of water which is provided with a catalyst for optimum efficiency of the water decomposition.

Further object of the invention will become apparent from the description of the invention which follows.

Accordingly, the objects of the invention are attained by an electrode for electrolysis of water which comprises a porous graphite plate having one major surface coated with a thin layer comprising titanium and titanium dioxide.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawing which illustrates a cross section through an electrode according to this invention.

DETAILED DESCRIPTION OF THE PREFERRED EMBODIMENTS

It has been discovered that it is advantageous to make an electrode for water electrolysis from a porous, permeable material based on carbon. The surface of the electrode which faces the electrolyte is preferably protected from corrosion by a layer comprising titanium and titanium dioxide. The layer of titanium/titanium dioxide preferably has a thickness of 0.1 to 0.5 micrometers.

In order to catalyze the electrolytic decomposition of water, that is to accelerate the reaction and lower the voltage drop at the electrode, the titanium/titanium oxide layer is preferably doped with a catalyst composed of an oxide of at least one platinum metal. For purposes of this application the platinum metals are defined as ruthenium, rhodium, palladium, osmium, iridium, and platinum. The preferred catalyst is a mixture of ruthenium oxide and iridium oxide. The preferred proportions of these oxides in the catalyst are up to 20 mole percent of ruthenium dioxide and up to 80 mole percent of iridium dioxide.

It is preferred that the major surface of the porous graphite electrode opposite to the surface which is coated with the thin layer of titanium/titanium dioxide be provided with a number of grooves. These relatively shallow grooves may have dimensions such as to provide a square cross section of about 1 $mm^2$.

Referring now to the drawing which illustrates a preferred embodiment of this invention, the illustrated electrode comprises a porous graphite plate 1 having a pattern of parallel grooves 2 on one major surface thereof. This is the side of the electrode which faces the supply of water. The grooves serve to channel the flow of water across the face of the electrode. The other major surface of the electrode, which faces the electrolyte, is coated with a thin layer 3 of a mixture of titanium and titanium dioxide. The layer of titanium/titanium dioxide is doped with a catalyst 4. The catalyst in a typical embodiment comprises a mixture of about 20 mole percent ruthenium dioxide and about 80 mole percent of iridium dioxide. The porous graphite plate 1 can have any overall shape, e.g. circular, square, rectangular, hexagonal, or octagonal.

Having generally described the invention, a more complete understanding can be obtained by reference to certain specific examples, which are provided herein for purposes of illustration only and are not intended to be limiting unless otherwise specified.

EXAMPLE

A finely porous circular graphite plate, 60 mm in diameter and 4 mm thick (e.g., Type S 1602 made by Le Carbone AG) was engraved with a pattern of grooves cut into one surface by a milling cutter. With a total surface area of 28 $cm^2$ the grooves had a breadth and depth to provide a square cross section of about 1 mm, and their distance apart was about 2 mm. Thereupon the smooth surface of the plate 1, which in operation faces the electrolyte, was cleaned by a glow discharge in a vacuum of $10^{-5}$ to $10^{-6}$ torr for 5 minutes. Thereupon a layer of titanium having a total thickness of about 1000 Angstroms was vapor-deposited on this surface at a deposition rate of 10 to 20 Angstroms per second. In operation this surface layer 3, as a result of local oxidation, consists for the most part of titanium with a minor proportion of titanium dioxide. In this way the underlying carbon (graphite) of the plate 1 is effectively protected from corrosive attack due to oxidation by the oxygen which is formed.

The plate 1 so prepared was then immersed for 10 seconds in an alcoholic solution of ruthenium chloride ($RuCl_3$) and iridium chloride ($IrCl_3$). The relative proportions of the dissolved salts were about 15 percent by weight of ruthenium chloride and about 85 percent by weight of iridium chloride. After draining for 1 minute, the plate was oxidized in air for 10 minutes at a temperature of 375° C. This process of immersion and oxidation was repeated a total of five times. Finally the plate was again oxidized in air for 4 hours at a temperature of 375° C. In this way the titanium coated surface of the porous plate was doped with a catalyst which comprised about 20 mole percent of ruthenium oxide and about 80 mole percent of iridium oxide. It was demonstrated in operation that this oxide mixture had excellent catalytic properties for the electrolysis of water.

The electrode of this invention is especially attractive because of its remarkably simple construction. Furthermore, it is relatively inexpensive to manufacture, since carbon (graphite) is an economical raw material.

The described process is especially advantageous for the manufacture of electrodes for high capacity water electrolysis apparatus used in the preparation of hydrogen. Because of the simplicity and economy of the electrodes prepared by this process they are especially suitable for series electrodes of large surface area which are used in industrial installations.

The electrodes prepared in this way are distinguished by a great chemical resistance and favorable decomposition voltage.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A porous electrode for electrolysis of water comprising a plate of porous graphite having one major surface thereof coated with a thin layer comprised of titanium and titanium oxide doped with a catalyst comprising mixture of about 20 mole percent of $RuO_2$ and about 80 mole percent of $IrO_2$ totalling 100% the thickness of said layer comprised of titanium and titanium oxide being from 0.1 to 0.5 micrometers, the coated graphite surface and the opposite uncoated graphite surface being exterior surfaces of the electrode.

2. The electrode of claim 1 having grooves on the major surface opposite to the surface coated with said layer comprised of titanium and titanium oxide.

* * * * *